US008035472B2

(12) United States Patent
Vail

(10) Patent No.: US 8,035,472 B2
(45) Date of Patent: Oct. 11, 2011

(54) CROSSED GAP FERRITE CORES

(75) Inventor: David Vail, London (GB)

(73) Assignee: Cambridge Semiconductor Limited (GB)

( * ) Notice: Subject to any disclaimer, the term of this patent is extended or adjusted under 35 U.S.C. 154(b) by 0 days.

(21) Appl. No.: 12/558,897

(22) Filed: Sep. 14, 2009

(65) Prior Publication Data

US 2010/0085138 A1 Apr. 8, 2010

(30) Foreign Application Priority Data

Sep. 16, 2008 (GB) ..... 0816921.1

(51) Int. Cl.
*H01F 27/24* (2006.01)

(52) U.S. Cl. ..... 336/212; 336/216

(58) Field of Classification Search ..... 336/212, 336/223, 232, 216
See application file for complete search history.

(56) References Cited

U.S. PATENT DOCUMENTS

| | | | | |
|---|---|---|---|---|
| 3,587,020 | A * | 6/1971 | Waasner | 336/212 |
| 3,603,864 | A | 9/1971 | Thaler et al. | |
| 3,659,191 | A * | 4/1972 | Spreadbury | 323/248 |
| 3,942,069 | A | 3/1976 | Kaneda | |
| 4,138,636 | A * | 2/1979 | Liberman | 336/165 |
| 4,594,295 | A * | 6/1986 | Waasner et al. | 428/581 |
| 4,602,236 | A * | 7/1986 | Shelby et al. | 336/216 |
| 4,728,918 | A * | 3/1988 | Neusser et al. | 336/83 |
| 5,155,676 | A * | 10/1992 | Spreen | 363/126 |
| 5,440,225 | A | 8/1995 | Kojima | |
| 5,469,053 | A * | 11/1995 | Laughlin | 324/207.18 |
| 5,506,560 | A * | 4/1996 | Takeuchi et al. | 336/83 |
| 5,816,894 | A | 10/1998 | Hosozawa et al. | |
| 5,847,518 | A | 12/1998 | Ishiwaki | |
| 5,861,792 | A * | 1/1999 | Ueda et al. | 336/234 |
| 6,232,864 | B1 | 5/2001 | Hosozawa et al. | |
| 6,281,776 | B1 * | 8/2001 | Davidson | 336/61 |
| 6,657,528 | B1 * | 12/2003 | Tang | 336/178 |
| 6,717,504 | B2 * | 4/2004 | Fujiwara et al. | 336/233 |
| 6,753,751 | B2 * | 6/2004 | Fujiwara et al. | 336/110 |
| 6,856,231 | B2 * | 2/2005 | Fujiwara et al. | 336/233 |
| 6,958,673 | B2 * | 10/2005 | Suzuki | 336/208 |

(Continued)

FOREIGN PATENT DOCUMENTS

| | | |
|---|---|---|
| EP | 0518421 A1 | 12/1992 |
| EP | 0577334 A2 | 1/1994 |

OTHER PUBLICATIONS

"Great Britain Application Serial No. GB0816921.1, Search Report dated Nov. 5, 2008", 2 pgs.

(Continued)

*Primary Examiner* — Anh Mai
*Assistant Examiner* — Joselito Baisa
(74) *Attorney, Agent, or Firm* — Schwegman, Lundberg & Woessner, P.A.

(57) ABSTRACT

The invention relates to swinging inductors of a stepped-gap construction. We describe an inductor core structure having first and second core segments, constructed and arranged such that distal ends of legs of the first core segment are paired with distal ends of legs of the second core segment in an opposing relation. The at least one distal ends of the first core segment has a ridge projecting therefrom and is paired with the at least one distal ends of the second core segment which has a ridge projecting therefrom in an opposing relation, such that opposingly paired projecting ridges form a cross arrangement.

11 Claims, 5 Drawing Sheets

U.S. PATENT DOCUMENTS

2003/0048644 A1 3/2003 Nagai et al.

OTHER PUBLICATIONS

"Step-gap "E" core swing chokes", *Magnetics, Inc. Technical Bulletin—Bulletin FC-S4*, (2001), 4 pgs.

Lee, S. T. S., et al., "Use of Saturable Inductor to Improve the Dimming Characteristics of Frequency-Controlled Dimmable Electronic Ballasts", *IEEE Transactions on Power Electronics*, 19(6), (2004), 1653-1660.

* cited by examiner

CROSSED GAP FERRITE CORES

RELATED APPLICATION

This application priority under 35 U.S.C. 119 to United Kingdom Patent Application Serial No. 0816921.1, filed Sep. 16, 2008; which application is incorporated herein by reference and made a part hereof.

FIELD OF THE INVENTION

The invention relates generally to the field of inductors, and more particularly to swinging inductors of a stepped-gap construction.

BACKGROUND TO THE INVENTION

Swinging inductors, often also referred to as swinging chokes, exhibit a relatively large inductance at light load and a progressively smaller inductance as the load increases. This makes them well suited for applications requiring good output regulation in the presence of variable load conditions. Switching power supplies and electronic ballasts are typical examples.

For such applications, swinging inductors offer a good practical compromise between designing for maximal load, in which case the inductance may be too low to meet the 'critical' inductance required at light load (i.e. that inductance necessary to prevent the inductor current from going to zero) and which may result in increased ripple on the output, and designing for increased inductance, which may result in a physically large inductor that is overspecified for the nominal load of the application.

To achieve variable inductance with DC bias (swinging choke), it is known practice to step-gap ferrite cores. Background prior art can be found in U.S. Pat. No. 5,816,894: Gap-providing ferrite core half and method for producing same; EP 0,518,421: Inductive device; U.S. Pat. No. 4,728,918: Storage coil with air gap in core; and U.S. Pat. No. 5,440,225: Core for coil device such as power transformers, choke coils used in switching power supply. Background information may also be found in S. T. S. Lee et al, "Use of Saturable Inductor to Improve the Dimming Characteristics of Frequency-Controlled Dimmable Electronic Ballasts", *IEEE Transactions on Power Electronics*, vol. 19, no. 6, pp.1653-1660, 2004.

Further background prior art can be found in U.S. Pat. No. 5,440,225 A (Kojima) FIGS. 1-8, US 2003/0048644 A1 (Nagai et al) FIGS. 2A-2E, EP 0577334 A2 (AT&T) FIGS. 1-6D and col. 1, lines 3-9, U.S. Pat. No. 3,603,864 A (Thaker et al) FIGS. 1-5, U.S. Pat. No. 3,942,069 A (Kaneda) FIGS. 11(A)-11(E), and U.S. Pat. No. 5,847,518 A (Ishiwaki) FIG. 11.

By way of example, FIG. 1 depicts a step-gap "E" core swing choke 100 according to the prior art (Technical Bulletin: Step-gap "E" core swing chokes, Bulletin FC-S4, Magnetics, Inc (Div. Spang & Co.), 2001). At low inductor current, the thinner part of the air gap ($G_1$) dictates a high inductance value. As the current is increased, the core at $G_1$ progressively saturates magnetically and the inductance will 'step' to a lower value determined by the thicker part of the air gap ($G_2$). The current can then be increased substantially with only a slight drop in inductance before the core at $G_2$ becomes saturated and the inductance is effectively reduced. It is also known to use a sloped step to create a more smoothly varying inductance, as described in U.S. Pat. No. 6,657,528: Slope Gap Inductor for Line Harmonic Current Reduction.

FIG. 2 depicts an alternative core structure 200 according to the prior art in which stepped portions formed on the two central legs of "E" core segments 202, 204 are contacted to form an ungapped section 206. The working principle is similar to that described above. Thus, the ungapped section 206 of the core saturates first as DC bias current is applied to a winding (not shown) around the central section. Typically, the ungapped area might be half the total area of the central leg in order to ensure consistency in manufacture, whereby the gap is typically cut with a pair of parallel grinding wheels. However, larger ungapped sections reduce the cross-sectional area of the core available for energy storage at higher DC bias, i.e. gapped sections 208. It is therefore desirable in some circuits to minimise the ungapped cross section, as shown in FIGS. 3*a* and 3*b*, in which comparable reference numerals are used to those applying to FIG. 2, but in the range 300 to 308. As is apparent, the inductor core structure 300 is generally similar to that of FIG. 2, but has a narrower ungapped section 306 relative to ungapped section 206, with consequent widening of gapped sections 308 relative to gapped sections 208.

However, narrower ungapped sections are prone to misalignment when the cores are assembled onto a bobbin, with resulting inconsistencies in manufacture. This is shown graphically in FIG. 4. As before, comparable reference numerals are used to those applying to FIGS. 2 and 3, but in the range 400 to 408. Misalignment may occur even though care is exercised to initially assemble the core elements in precisely aligned relation.

Due to the misalignment of the two core halves 402, 404, the contact area of the stepped sections 406 is reduced, thereby lowering the inductance of the core assembly and failing to achieve the desired inductance properties. This is especially the case at light load, for which the inductance of a device with misaligned core halves might be less than half that of a corresponding device with fully aligned core halves. The problem is exacerbated with smaller cores, largely due to tolerances of core and bobbin dimensions, where a bobbin might accept a range of core halves varying in size by around ±10%. Those core halves at the smaller end of this range may not securely engage together and could therefore slip out of position. Since the core's low load inductance properties depend on the contact area (or relative closeness, as the case may be for a fully gapped structure) of the step gap, such 10% linear variations may become detrimental.

Thus, for configurations such as those depicted in FIG. 3, if the two halves are both relatively small and become misaligned, the low load inductance value could be very similar to the high load inductance value. It will be appreciated that the misalignment shown in FIG. 4 is exaggerated for the purposes of explanation, and that even slight misalignment can result in variations of the inductance of the device.

Existing core configurations and manufacturing techniques are not entirely satisfactory at mitigating the detrimental effects of misalignment and ensuring a consistent inductor characteristic, and there is therefore a need for improved techniques.

SUMMARY OF THE INVENTION

According to a first aspect of the invention there is therefore provided an inductor core comprising: a first core segment having a body and a plurality of spaced legs extending from the body, each of said legs having a distal end relative to said body, at least one of said distal ends having a ridge projecting therefrom; and a second core segment having a body and a plurality of spaced legs extending from the body, each of said legs having a distal end relative to said body, at least one of said distal ends having a ridge projecting therefrom; wherein said first and second core segments are constructed and arranged such that distal ends of legs of the first core segment are paired with distal ends of legs of the second core segment in an opposing relation, whereby said at least one distal ends of said first core segment having a ridge projecting therefrom being paired with said at least one distal ends of said second core segment having a ridge projecting therefrom in an opposing relation, and wherein said opposingly paired projecting ridges form a cross arrangement.

By providing such a cross arrangement, the inductor is less susceptible to the influence of misalignment errors resulting from core and bobbin tolerances, thereby enabling more reproducible inductance performance. Broadly speaking, this is because a substantially constant area of crossover between opposed ridges can be maintained. Appropriate dimensioning and positioning of the ridges on the distal ends facilitates variable sizing of this area.

In some preferred embodiments, the role of physically bridging a gap between two core segments is shared equally between opposingly paired projecting ridges. This is advantageous since the resulting ridges may be reduced in height compared to the situation where only one ridge is provided for a pair of opposed distal ends. Thus, increased robustness and ease of manufacture may be achieved since ridges of core segments become less susceptible to damage.

In some preferred embodiments a gap between core segments may be bridged completely by contacting opposing ridges, while in other preferred embodiments a gap is only bridged partially such that opposing ridges are separated from each other. The gap between opposing distal faces is preferably an air gap, though a nonmagnetic filler could also be used.

In some preferred embodiments the first and second core segments are substantially identical. This significantly reduces the likelihood of incorrectly mixing core segments, and makes assembly of the inductor easier. However, in other preferred embodiments, asymmetrical cores may be implemented. For example, one core could have a relatively larger ridge compared to the opposing ridge.

In some preferred embodiments, multiple diagonal ridges are provided on distal ends of at least one of the legs on one or both of the core segments.

In some preferred embodiments one or both of the core segments are E-shaped cores, though it will be apparent that other core shapes including I- and U-shaped cores may equally by implemented.

In preferred embodiments the core segments are ferrite cores.

In preferred embodiments, the inductor core comprises more than two segments.

In a related aspect of the invention there is provided an inductor core assembly comprising an inductor core according to the first aspect of the invention; a winding; and a bobbin. The inductor core assembly may be implemented in, for example, a switching power supply, an electronic ballast, and a power electronic circuit.

According to another aspect of the invention there is provided a method of manufacturing an inductor core segment, the method comprising: supplying a material comprising a ferrite in a molded body shaped to form a core segment for use in an inductor core according to the first aspect of the invention; and firing the molded body having said material to form the core segment.

This is advantageous as the core segments could be manufactured without the need for post-processing, such as grinding, to refine the gap. The material could be a single homogeneous mass of ferrite material.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 5:
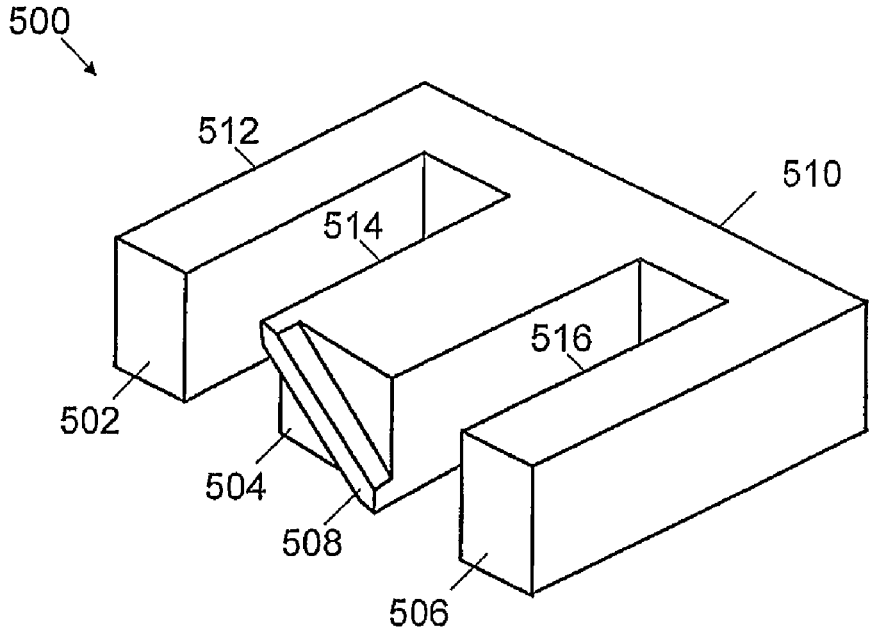
FIGS. 5 and 6 show oblique and bottom views respectively of a core segment according to the present invention.

In one specific embodiment of the present invention shown in FIG. 5, an E-shaped core segment 500 has a base 510 from which a plurality (in this case three) of legs 512, 514, 516 extend in a direction perpendicular thereto. The legs are spaced apart to allow a coil (not shown) to be fit over the top of, for example, the central leg. Each of the legs has a respective end surface 502, 504, 506. The central leg 504 has a protruding ridge 508 running diagonally across the rectangular surface from one corner to another. In this particular embodiment, end surfaces 502, 506 are flat and co-planar with the plateau of ridge 508.

Figure 6:
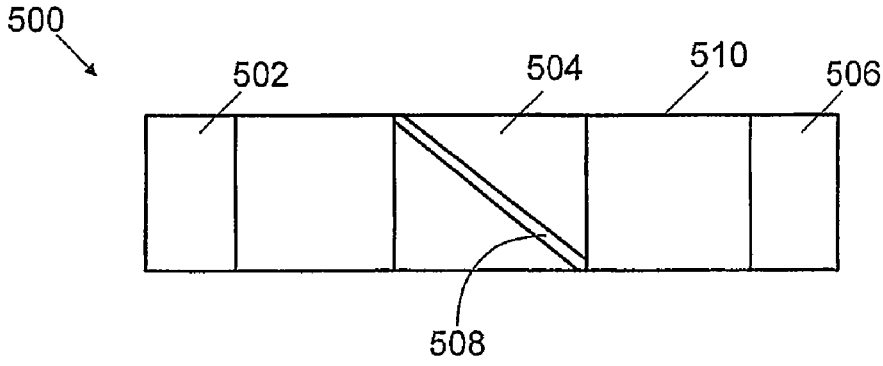

In FIG. 6, the core segment 500 is shown as seen when viewed looking at the end surfaces 502, 504, 506. Like reference numbers are used to denote like parts.

Figure 7:
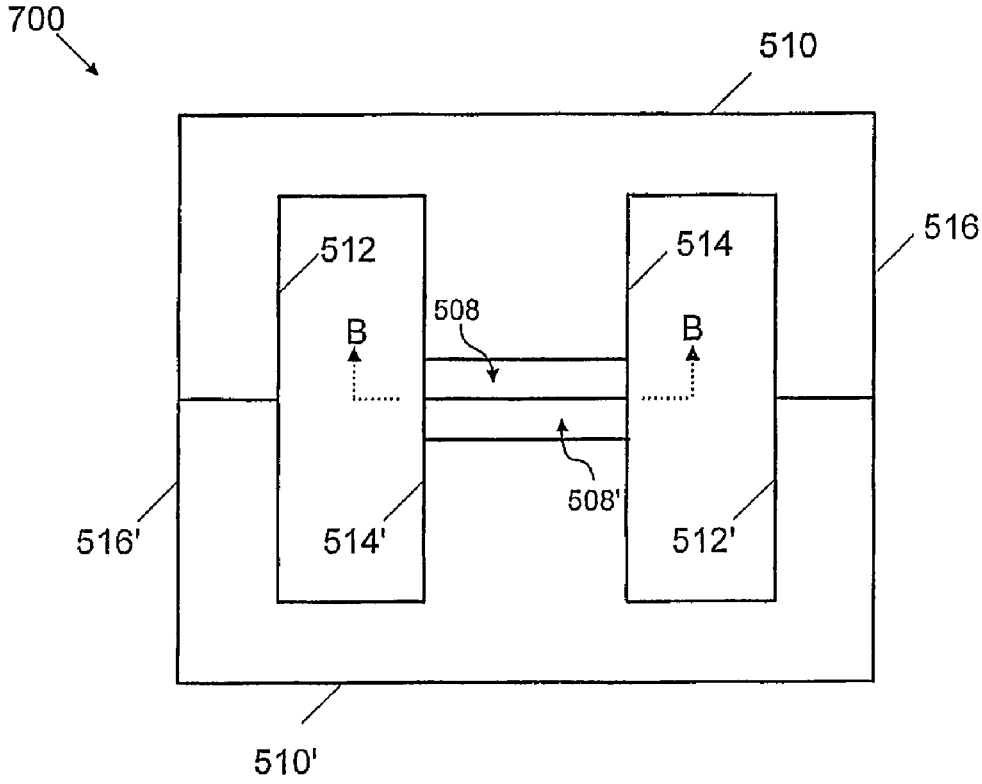
FIG. 7 is a plan view of a core structure according to the present invention.
Figure 8A:
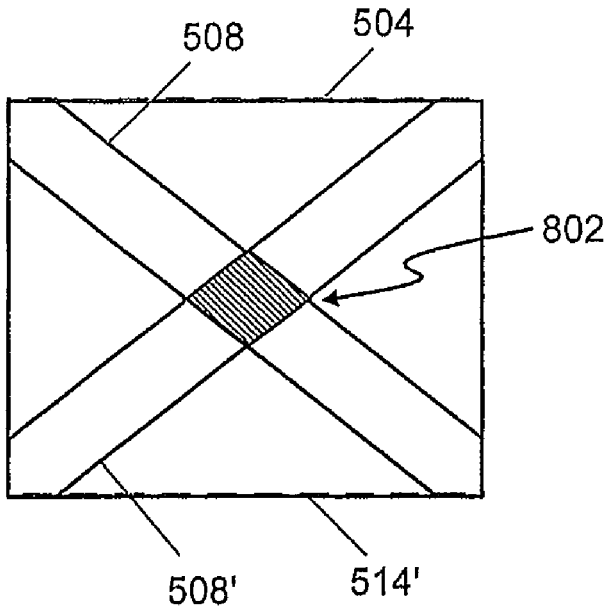
FIGS. 8*a* and 8*b* show a view along axis B-B of FIG. 7 for aligned and misaligned core segments respectively.

An advantage of such an arrangement is that the likelihood of incorrectly mixing cores is essentially prevented, since two of the same core segments can be mated in only one possible orientation to form the inductor core structure 700 depicted in FIG. 7. In this way, each of the outer columns is formed of a pair of opposite legs (512, 516'), (516, 512'), with the ridges of the central legs 514, 514' oriented at an angle to one another. This is more readily apparent from FIG. 8*a*, which shows a view along axis B-B of adjoining legs 514, 514'.

Figure 1:
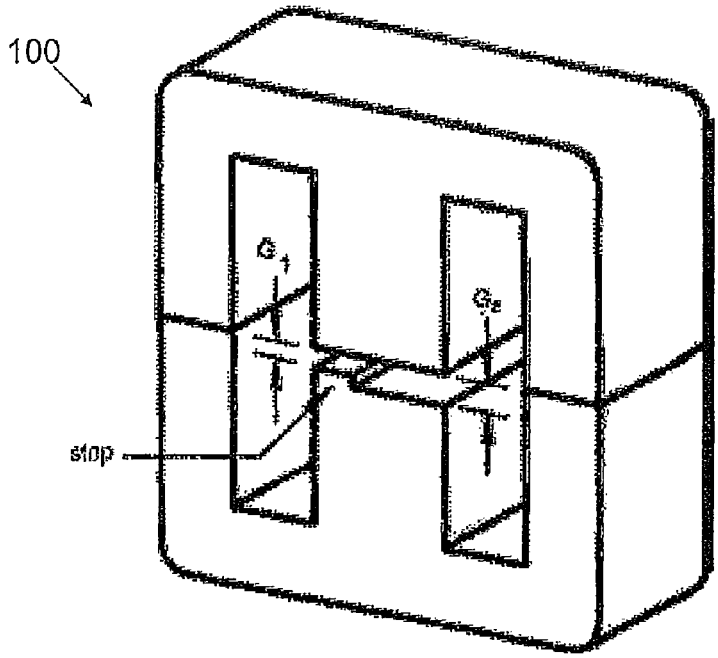
FIGURE 1 (PRIOR ART)
FIG. 1 is an oblique view of a swing choke core structure according to the prior art.
Figure 2:
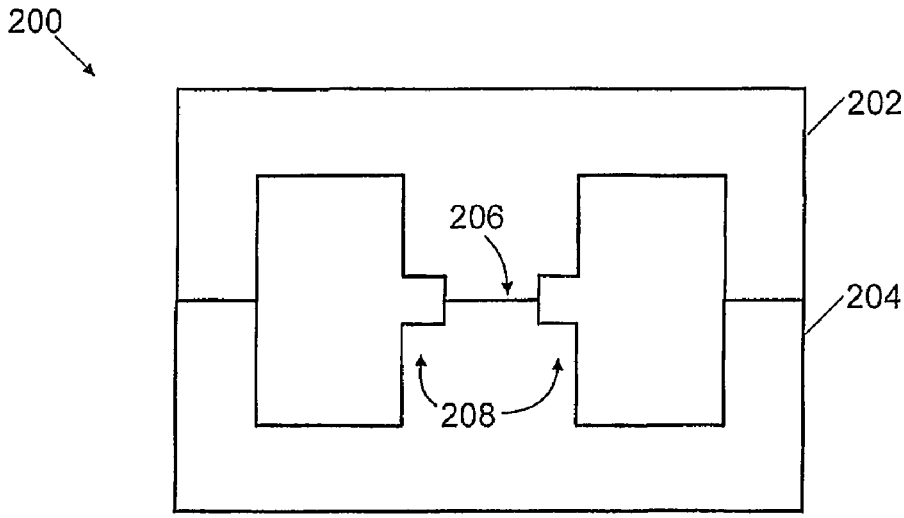
FIGURE 2 (PRIOR ART)
FIG. 2 is a plan view of a core structure according to the prior art.
Figure 3A:
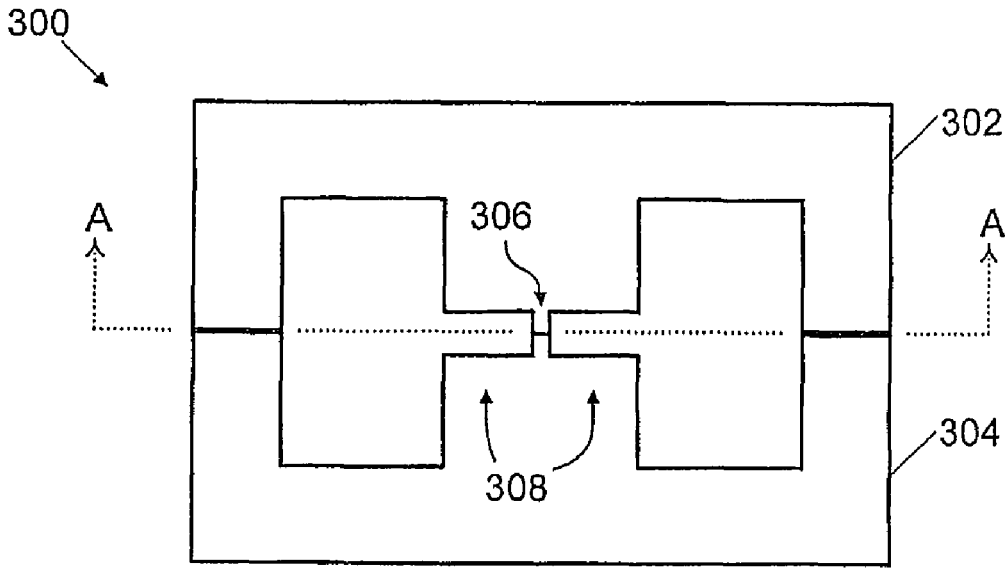
FIGURE 3a (PRIOR ART)
FIGS. 3*a* and 3*b* show a plan view of another core structure according to the prior art and a view along axis A-A of adjoining core segments.
Figure 3B:
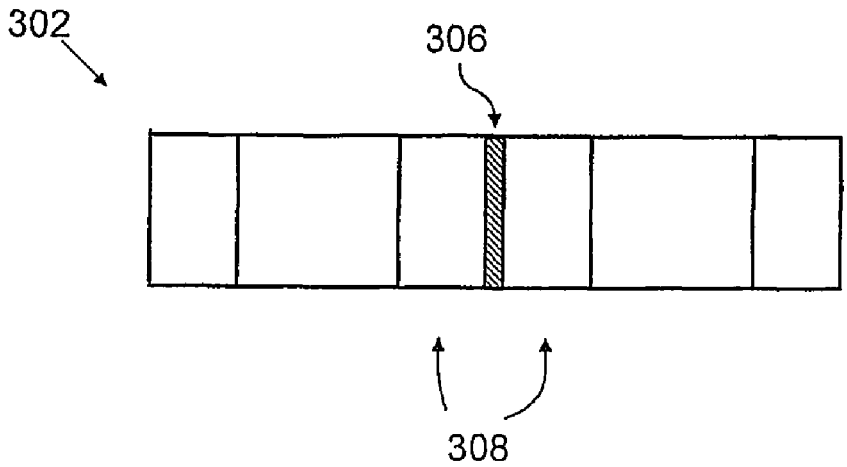
FIGURE 3b (PRIOR ART)
Figure 4:
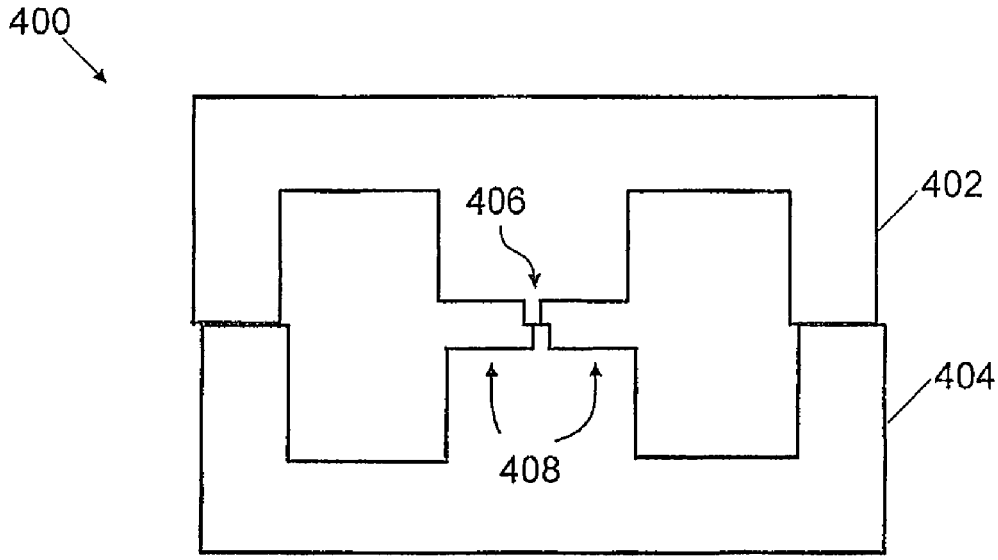
FIGURE 4 (PRIOR ART)
FIG. 4 is a plan view of the core structure of FIG. 3*a* showing a misalignment of core segments.
Figure 8B:
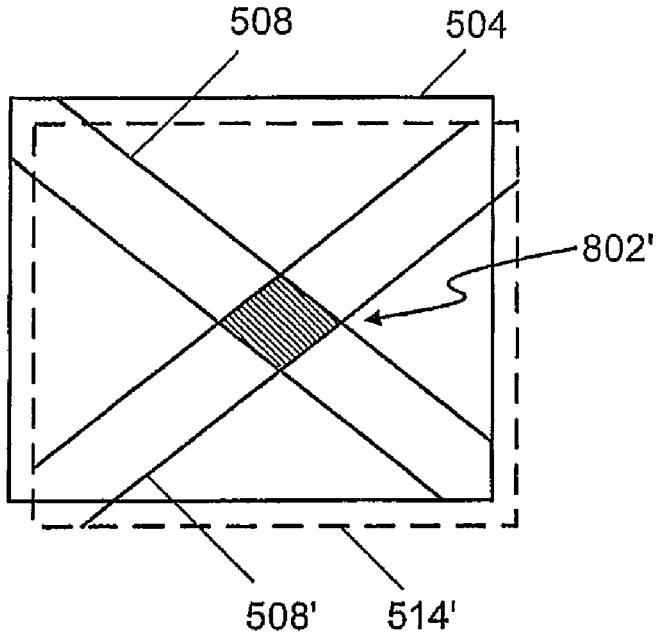

Ridge 508 of leg 504 and ridge 508' of leg 504' form an X- or cross-shaped configuration, resulting in a quadrilateral contact area 802. This arrangement ensures that any lateral or longitudinal misalignment of the mated core segments minimally affects the shape of the contact area 802', as is evident from FIG. 8*b*. This is different from the inductor core structure shown in FIG. 4, in which the contact area of the central leg varies significantly with movement.

For non-contacting ridges, the resulting swing in inductance is typically less pronounced than that for contacting ridges, and usually less variable. In other words, the inductance of the core is generally sensitive to any air gap, even microscopic gaps where two contacting legs aren't substantially smooth and flat. Typically, in cores having contacting ridges there may be a 25% variation in inductance due to small air inclusions and non-ideal contact. In cores with non-contacting ridges the fine variability of the structure has less effect on inductance, which may vary by, for example, 5%.

It will be apparent that ridges need not form an X- or cross-shaped configuration running from corners of the leg face. For example, opposed ridges could be at some other angle with respect to each other (and could be asymmetric), and/or the ridges could extend in length only for a portion of the thickness of the legs. Similarly, the legs of the core segments need not be rectangular in cross-section, but could be tubular shaped for example, nor do all of the legs need to be of the same shape. It will also be apparent to the skilled reader that the design of the ridges can be of any configuration permitting relative movement of the core segments whilst maintaining overlap or contact over substantially the same surface area, for example substantially perpendicular ridges.

It will be further understood that while the invention has been described in the context of E-shaped core, embodiments of the present invention could employ any two core segments from, for example, E-, I- and U-shaped types to form EI, EE, UI and UU-shaped type inductor cores for example. In addition, although the foregoing discussion has made reference to cores of relatively small size, it will be apparent that the described invention is not limited to particular core sizes.

No doubt many other effective alternatives will occur to the skilled person. It will be understood that the invention is not limited to the described embodiments and encompasses modifications apparent to those skilled in the art lying within the spirit and scope of the claims appended hereto.

I claim:

1. An inductor core comprising:

a first core segment having a body and a plurality of spaced legs extending from the body, each of said legs having a distal end relative to said body, at least one of said distal ends having a ridge projecting therefrom; and a second core segment having a body and a plurality of spaced legs extending from the body, each of said legs having a distal end relative to said body, at least one of said distal ends having a ridge projecting therefrom;

wherein said first and second core segments are constructed and arranged such that distal ends of legs of the first core segment are paired with distal ends of legs of the second core segment in an opposing relation, whereby said at least one distal ends of said first core segment having a ridge projecting therefrom is paired with said at least one distal ends of said second core segment having a ridge projecting therefrom in an opposing relation, and wherein said opposingly paired projecting ridges are oriented to cross at an angle to one another to form a cross arrangement.

2. An inductor core according to claim 1 wherein said opposingly paired projecting ridges are in a contacting relation with one another.

3. An inductor core according to claim 1 wherein said first and second core segments are substantially identical.

4. An inductor core according to claim 1 wherein at least one of said distal ends of one or both of said first and second core segments has a plurality of ridges projecting therefrom.

5. An inductor core according to claim 1 wherein the first and second core segments define E- or U-shaped core segments.

6. An inductor core segment for use in an inductor core in accordance with claim 1.

7. A method of manufacturing an inductor core segment, the method comprising:

supplying a material comprising a ferrite in a molded body shaped to form a core segment according to claim 6; and firing the molded body having said material to form the core segment.

8. An inductor core assembly comprising:

an inductor core according to claim 1;

a winding; and a bobbin.

9. A switching power supply including an inductor core assembly according to claim 8.

10. An electronic ballast including an inductor core assembly according to claim 8.

11. A power electronic circuit including an inductor core assembly according to claim 8.

* * * * *